US006907309B2

(12) United States Patent
Zipperer

(10) Patent No.: US 6,907,309 B2
(45) Date of Patent: Jun. 14, 2005

(54) TEXTILE MACHINE WITH AT LEAST ONE SERVICE UNIT

(75) Inventor: Martin Zipperer, Denkendorf (DE)

(73) Assignee: Rieter Ingolstadt Spinnermaschau AG, Ingolstadt (DE)

( * ) Notice: Subject to any disclaimer, the term of this patent is extended or adjusted under 35 U.S.C. 154(b) by 154 days.

(21) Appl. No.: 10/202,402

(22) Filed: Jul. 24, 2002

(65) Prior Publication Data

US 2003/0056487 A1 Mar. 27, 2003

(30) Foreign Application Priority Data

Jul. 28, 2001 (DE) ..... 101 36 983
Feb. 12, 2002 (DE) ..... 102 05 656

(51) Int. Cl.[7] ..... G06F 19/00
(52) U.S. Cl. ..... 700/130; 57/264; 57/265
(58) Field of Search ..... 700/139, 130; 57/1 R, 268, 264; 104/173.1

(56) References Cited

U.S. PATENT DOCUMENTS

| | | | | |
|---|---|---|---|---|
| 4,192,129 A | | 3/1980 | Stahlecker | |
| 4,418,525 A | | 12/1983 | Raasch | |
| 4,532,759 A | * | 8/1985 | Bischofberger | 57/264 |
| 4,768,443 A | * | 9/1988 | Bruggisser et al. | 104/173.1 |
| 4,840,022 A | * | 6/1989 | Karl et al. | 57/263 |
| 4,890,450 A | * | 1/1990 | Karl et al. | 57/1 R |
| 4,944,033 A | | 7/1990 | Erni | |
| 5,347,449 A | | 9/1994 | Meyer et al. | |
| 5,386,684 A | * | 2/1995 | Simon et al. | 57/264 |
| 5,801,949 A | | 9/1998 | Raasch et al. | |
| 6,014,592 A | | 1/2000 | Fechter et al. | |
| 6,226,971 B1 | | 5/2001 | Stephan | |
| 6,474,461 B1 | | 11/2002 | Grabovszky | |
| 2003/0036816 A1 | | 2/2003 | Zipperer | |
| 2003/0056486 A1 | | 3/2003 | Bahlmann et al. | |

FOREIGN PATENT DOCUMENTS

| | | |
|---|---|---|
| DE | 2454483 C2 | 5/1976 |
| DE | 3900229 A1 | 7/1990 |
| DE | 3909746 A1 | 10/1990 |
| DE | 3942406 A1 | 6/1991 |
| DE | 3942916 A1 | 7/1991 |
| DE | 4221504 C2 | 1/1993 |
| DE | 4212629 A1 | 10/1993 |
| DE | 4216512 C2 | 11/1993 |
| DE | 19547068 | 6/1997 |
| EP | 0394671 B1 | 10/1990 |
| EP | 0433775 B1 | 6/1991 |

* cited by examiner

*Primary Examiner*—John J. Calvert
*Assistant Examiner*—Brian Kauffman
(74) *Attorney, Agent, or Firm*—Dority & Manning, P.A.

(57) ABSTRACT

The invention relates to a textile machine with at least one first service unit capable of traveling along a guide rail alongside a plurality of processing stations of the textile machine, and with a control system for the control of the travel movement of the service unit. The control system can determine data on travel path delimitations, predetermined return points and/or obstacles available, and the control system controls the travel movement as a function of the data of the travel path delimitations, the predetermined return points and/or the obstacles.

22 Claims, 3 Drawing Sheets

TEXTILE MACHINE WITH AT LEAST ONE SERVICE UNIT

BACKGROUND

The present invention relates to a textile machine with a control system to control the travel movement of an associated service unit, whereby the service unit is capable of being moved along a guide rail alongside a plurality of processing stations of the textile machine to service and/or control the processing stations.

In a known open-end spinning machine (DE 31 11 627 A1), two different service units can be moved on a guide rail alongside a plurality of identical spinning stations. One of the service units has a travel obstacle signaler for each direction of travel, connected to a travel direction-reversing device. Each time a travel obstacle signaler meets an obstacle, the travel direction-reversing device reverses the travel direction of the service unit. In this process, a bodily "detection by scanning" of obstacles along the traveling path takes place, and the reversal of the direction of travel is initiated independently of the nature of the obstacle.

In another known open-end spinning machine (DE 199 30 644 A1), identical service units can be moved alongside a plurality of spinning stations along a guide rail of the open-end spinning machine. A sensor recording an obstacle on the travel path and initiating the reversal of the direction of travel of the service unit at the occurrence of such obstacles is proposed in this case for each service unit. Thereby a collision of the service units with each other is also avoided.

SUMMARY

It is a principal object of the invention to provide a textile machine with at least one service unit, and a process for making it possible to control the movement of the service unit in a flexible and efficient manner while taking into account obstacles or operating zones. Additional objects and advantages of the invention will be set forth in part in the following description, or may be obvious from the description, or may be learned through practice of the invention.

According to one embodiment, at least one first service unit can be moved along a guide rail alongside a plurality of processing stations of a textile machine. The service unit carries out maintenance functions and/or control functions on the processing stations. The traveling movement of the service unit is controlled by a control system. Data of travel path limits, predetermined return points and/or obstacles can be stored in the control system, e.g. in a memory from which they can be called up. The control system takes into account the stored data on travel path limits, predetermined return points and/or obstacles as it controls the travel movement.

Service units are in this case regular robots performing different tasks at the processing stations of the textile machine, cleaning robots, etc. Such tasks are e.g. the cleaning of the workstations, the return to the workstation in case of a malfunction or the presentation of initial products, etc. In an open-end spinning machine, the replacement of bobbins is in addition carried out e.g. by a piecing robot when a bobbin has been filled with spun yarn, or piecing is effected at the spinning station in case of yarn breakage.

An obstacle in the sense of this application is an obstacle that is "known" to the textile machine. For this, data concerning a "known" obstacle is made available in a control system or through the interaction of several control systems. Such an obstacle is here normally another service unit, a service station of a service unit occupied at the moment by a service unit, a spinning station being serviced that cannot be passed, an obstacle determined as such by a data entry, etc. An obstacle of this kind therefore need not be detected without contact or through physical contact through the intermediary of a detection device, but the presence of such an obstacle is construed on the basis of already existing data. The detection devices operating without contact or through contact detect unknown obstacles that are also taken into account in controlling the travel movement. A maintenance worker on the travel path is for example such an unforeseen obstacle.

A return point is here normally any pre-determined point along the guide rail over which the service unity could physically move. The return point is determined by means of data entry by the control system or e.g. by an operator.

A travel path limit is here normally the end point of the guide rail or an additional, optional component on a textile machine indicating the fixed end of the travel path of the service unit before which the service unit is preferably decelerated already during its approach.

By making data available on obstacles, travel path limits and/or predetermined return points, the travel movement control can be adjusted in a flexible and efficient manner since travel of the service unit is not simply continued until a physical or contact-less detection of the actual presence of an obstacle takes place.

If a control system of the service unit and/or of the textile machine is used to control the travel movement, the travel path control can be implemented by an already existing control unit. The hierarchical division of the travel path control is broken down preferably in adaptation to the existing, hierarchical division of the control units. Thus, for example, the travel movement control of a service unit is taken over by its control system, whereby the latter is made available to data on other service units, travel path limits or predetermined return points through the control system of the textile machine (central machine control). The travel movement control may be taken over through the controls of the textile machine, e.g., the central machine control, so that only movement commands are transmitted from the latter to the control system of the service unit. Alternatively, only distance data and data concerning the type of obstacle are provided by the central machine control, so that the control system of the service unit initiates additional control measures under inclusion of additional data such as, e.g., the position and/or the speed of the service unit.

In an especially advantageous embodiment, the data concerning at least one second service unit is made available. As a result of this, the travel movement control of the first service unit can be coordinated with the second service unit. This is especially advantageous when one side of the textile machine is assigned at least two or three service units on a permanent basis. Since all service units service processing stations adjoining each other or are able to service them, the danger of collision between service units is especially great. Since the service units approach each other frequently, the mechanical constraint caused by rapid braking before the other service unit would be especially great, and this would result in increased wear of a carriage of the service unit. By providing data on the other service unit, it is thus possible to take appropriate measures, e.g. soft braking, already in the approach zone.

The data, e.g. position, speed etc., is preferably transmitted among the service units via the communication channel between each service unit and the central machine control (control unit of the textile machine). It is however also possible for the data to be exchanged among the service units, and for every service unit to then carry out the travel movement control in accordance with the exchanged data. Such a data exchange can be effected via an optical communications channel between the service units.

In the process for the control of travel movement according to an embodiment of the invention, the travel movement is controlled as a function of data regarding travel path limits, predetermined return points and/or obstacles, whereby this data is provided by a control system. The data also contains the type of obstacle so that obstacle-specific data can be taken into account in the control of the travel movement. Therefore, no blind "feeling around" the travel path takes place, nor do any avoidance movements of the service unit occur that are not dependent on obstacles.

In order to treat the carriage of the service unit with care, braking is initiated preferably as a function of the current speed of the service unit and the distance from the obstacle.

Thanks to the knowledge of the type of obstacle, e.g. a merely passing obstacle such as another service unit, the further travel behavior of the service unit can be rendered dependent upon the type of an obstacle once it has been ascertained. If it is learned from the data of the obstacle that it will soon no longer be present, it may suffice for example to merely slow down the movement of the service unit in the direction of the obstacle, or else the service unit may be stopped before the obstacle to remain there in readiness until the obstacle has left.

Preferably the work status of a second service unit is also transmitted together with the other data, so that it may be ascertained which travel movement the first service unit carries out next, based on the work status of the second service unit. Thereby, the operating efficiency of the first service unit is increased. The latter reverses its direction of travel, for example, if the second service unit is active for a longer period of time at a processing station. If the second service unit remains only for a short time at the processing station, e.g. to blow-clean a spinning station of a rotor spinning machine, the first service unit can wait for the end of the activity of the second service unit and continue its travel thereafter.

In the process according to another embodiment, the data regarding the predetermined operating zones of a first and a second service unit can be obtained and the control of the travel movement takes place as a function of this obtained data. For each service unit, its own work zone is thereby managed. Here, more than two service units can be provided, with the work zone of each being defined in the control system for each service unit. The details regarding service units, control system, etc. described earlier apply here accordingly.

If one of the service units is taken out of operation, the area going from the border zone of the work zone of the other service unit to the position of the service unit taken out of operation of the other service unit is added for maintenance and/or control of the processing stations. The service unit may be out of operation because it was taken out of operation, because a defect has occurred in the service unit, because the control of the service unit has failed, because some service is being performed on the service unit, because the textile machine is not yet in operation, etc. A state in which the service unit is unable to determine its present position or cannot transmit the present position to the control system (control system of the service unit and/or of the textile machine) is considered to be out of operation. In the latter case, the service unit is preferably stopped and remains in its position.

The position of the service unit taken out of operation is either detected by the service unit and is transmitted to the control system, or that position is assumed to apply in which the last position message was transmitted from the service unit to the control system. In addition to the software-controlled avoidance of collision between the first and the second service unit, a detection device is preferably provided for an obstacle (see below) by means of which the service unit which is now out of operation can be detected in case that the last announced or currently announced position does not coincide with the actual position.

The current position of the service unit taken out of operation is advantageously detected by a detection device or is transmitted by an operator to the control system. A detection device for the detection of the position of the service unit taken out of service may e.g. be located at the service unit that is in operation.

If the first as well as the second service unit is out of operation, such as may be the case when the textile machine is switched on again, the absolute position of the two service units is at first unknown. In order to avoid a collision, the operating zone of the service unit first put into operation is determined only within the zone over which the service unit first put into operation was moved into its initialization position without collision with the other service unit. If both service units are for example at the same end of the overall operating zone of processing stations, and if the initialization position of one service unit is at the other end, the service unit, as it travels to the other end, determines that all the processing stations located between the two ends can be approached without collision, so that initially this entire zone of the first initialized service unit is determined to be its operating zone.

The operating zone of a service unit in operation or of a service unit first put into operation can be extended or reduced by those processing stations around which the other, not yet operative service unit is moved, e.g. during the travel of the other, not yet operative service unit to its initialization position. For each service unit, an initialization position or a plurality of initialization positions to be approached as desired can thereby be provided. The absolute position of the service unit at the textile machine is determined in one initialization position. In an initialization displacement, a service unit is preferably moved into the direction opposite to the direction of the other service unit. The initialization displacement can be initiated by the control system or by an operator. The service unit can also be pushed by the operator without using the drive of the service unit.

The course of travel or the relative position of a service unit taken out of operation is detected by means of position markings or by detection devices along the travel path of the service unit, whereby the direction of travel is also detected.

Only when both service units have been initialized, i.e., when their absolute position at the textile machine has been determined, are the original operating zones of each service unit released once more.

The embodiments of the invention are explained in further detail through drawings.

DESCRIPTION

Reference will now be made in detail to embodiments of the invention, one or more examples of which are illustrated in the figures. The embodiments are presented by way of explanation of the invention, and not as a limitation of the invention.

Figure 1:
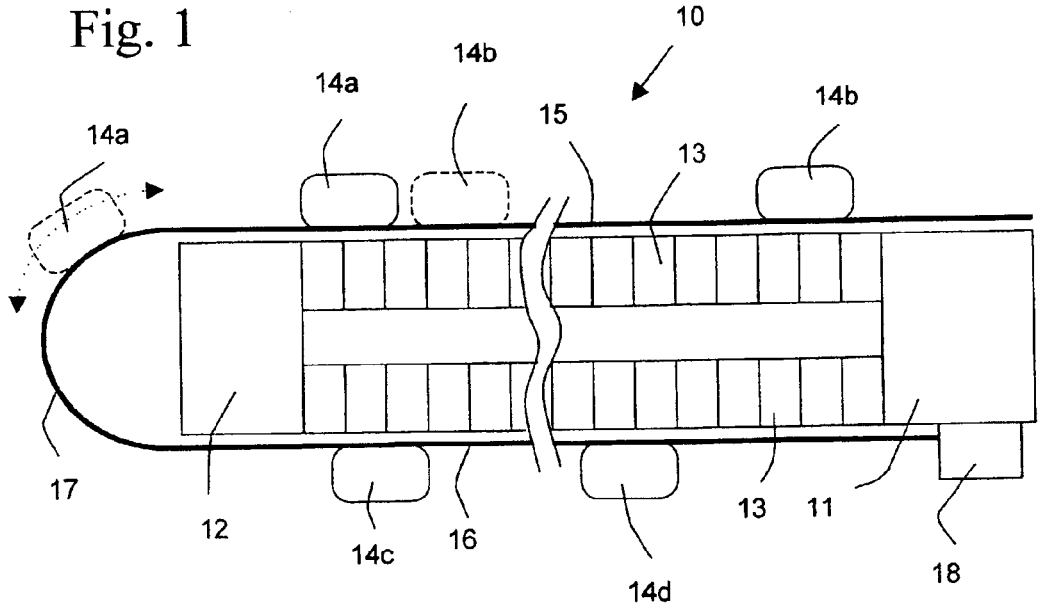
FIG. 1 shows a schematic top view of a rotor spinning machine with two piecing robots per spinning machine side.
Figure 2:
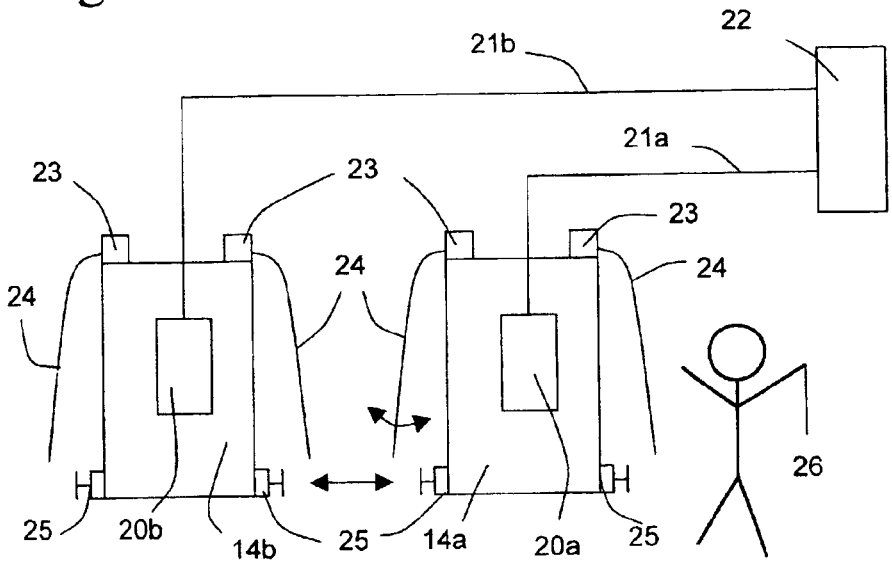
FIG. 2 shows a schematic side view of two piecing robots capable of traveling on a common guide rail.

FIG. 2 shows a schematic side view of the piecing robots 14*a–d* (FIG. 1). In each of the piecing robots 14*a*, 14*b* a control unit 20*a*, 20*b* is provided that is connected via a communications connection 21*a*, 21*b* to a central machine control or spinning machine control system 22 of the rotor spinning machine 10. The communications connection 21*a*, 21*b* can be a data conduit for example, contained together with the supply conduits in the drag chain.

In the upper area of each of the piecing robots 14*a*, 14*b*, a switching unit 23 is provided in which a switching hoop 24 is pivotally mounted. The switching hoop 24 protrudes laterally from the piecing robots and extends in its lower part over the width of the piecing robots. The switching hoop 24 can be swiveled towards the piecing robot. The switching hoops 24 serve to detect a lateral obstacle such as e.g. an operator 26 of the rotor spinning machine 10 as sketched in FIG. 2. By swiveling the switching hoop 24 slightly towards the inside, a switching contact is established in the switching unit 23 and the piecing robot 14*a*, 14*b* is braked. Furthermore additional switching steps beyond the first contact point are provided when the switching hoop 24 is swiveled further. Thereby a second switching contact is actuated as the switching hoop 24 is swiveled further inward, causing increased deceleration of the piecing robot. Finally, when the switching hoop is swiveled completely inward, a third switching contact is actuated, resulting in the abrupt stopping of the piecing robot. In addition, an emergency stop switch button 25 that also causes the abrupt stopping of the piecing robot when encountering an obstacle or when actuated by an operator 26 is provided on each piecing robot.

The data on the absolute positions of the piecing robots (see below) determined in the control unit 20*a*, 20*b* or in the spinning machine control system 22 is exchanged, so that the relative distance between two piecing robots can be calculated through the absolute position information. Thereby the distance from another piecing robot which also represents an obstacle on the travel path due to the common travel path along the guide rail is detected. The distance between a piecing robot 14*a–d* from an obstacle, e.g. from an empty-bobbin feeding device 18, is calculated in the same way.

Figure 3:
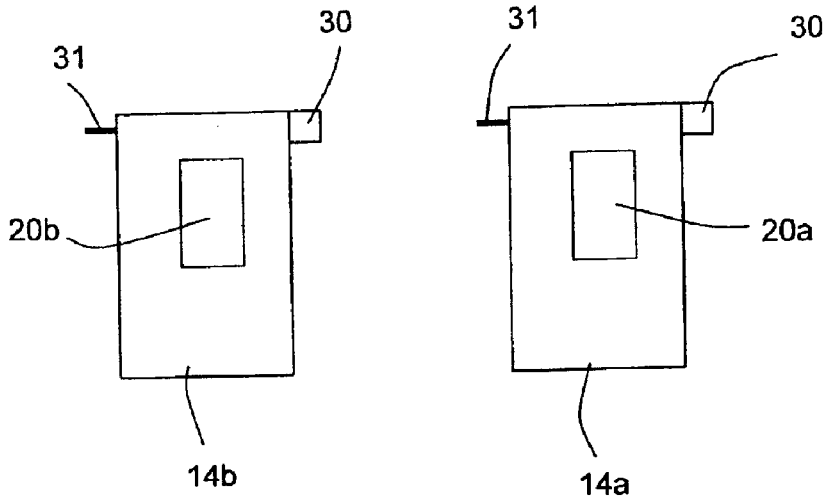
FIG. 3 shows a schematic side view of two piecing robots with a contact switching device.

FIG. 3 shows a second embodiment of an obstacle-detecting device serving to avoid a collision between the piecing robots 14*a*, 14*b*. Here switches 30 are provided in the right upper lateral area of the piecing robots 14*a*, 14*b* (in the side view of FIG. 3), and these switches are triggered by pins or projections 31 on the facing side of the adjoining piecing robot. The switch 30 and the pin 31 are provided as alternatives to the emergency stop switch button 25 and the switching hoop 24 of FIG. 2, or in addition to the emergency stop switch button 25 and/or the switching hoop 24. In the latter case, a redundant detection device for the avoidance of collisions is made available for the case that the emergency stop switch button 25 and/or the switching unit 23 connected to the switching hoop 24 would not be triggered. The switches 30 are connected to the control units 20*a*, 20*b* that monitor the switching signal of the switches 30 and cause the stopping of the piecing robots at the appearance of a signal. A switch as well as a pin 31 is advantageously provided on each side of the piecing robot, so that collision monitoring is effected for either direction of travel for each piecing robot 14*a*, 14*b*.

Figure 4:
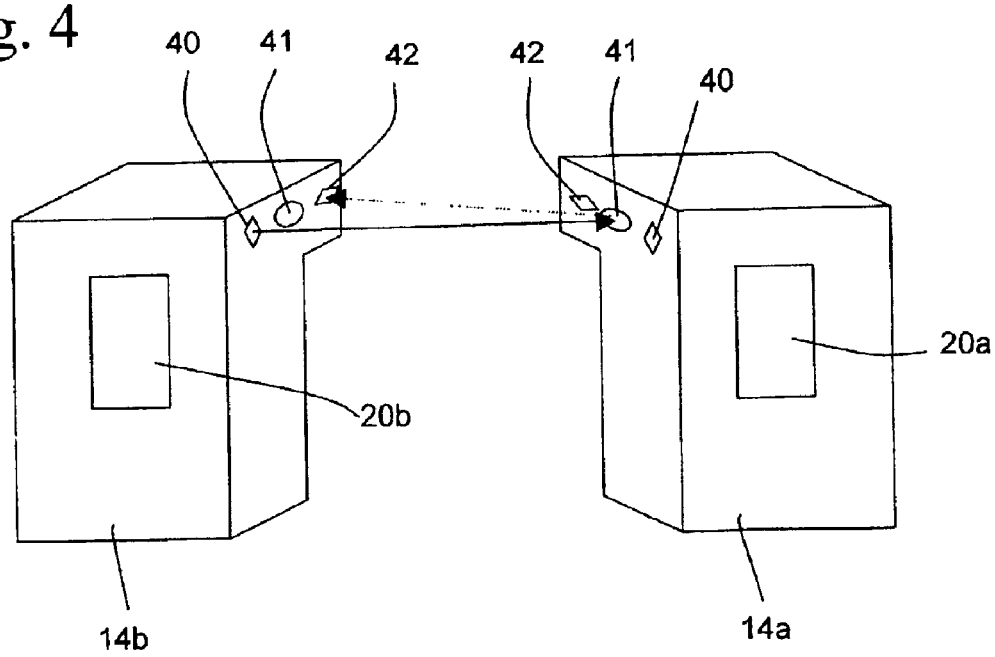
FIG. 4 shows a side view in perspective of two piecing robots with laterally installed detection devices.

FIG. 4 shows a lateral view in perspective of the piecing robots 14*a*, 14*b*. On the lateral surfaces of each of the piecing robots 14*a*, 14*b*, a transmission unit 40, a reflector 41 and a receiver 42 are provided side by side. The transmission unit 40 emits a light signal at an angle to the vertical of the lateral surface. At a given distance between the piecing robots 14*a*, 14*b* the ray coming from the transmission unit 40 that is bundled in the direction of the room meets the reflector 41 of the facing piecing robot. From there the light ray is reflected at the angle of incidence and is thrown back to the emitting piecing robot 14*b*. There, the light ray reaches the receiver 42. As a result the receiver 42 only receives the signal emitted by the transmission unit 40 when a defined distance is kept between the piecing robots 14*a*, 14*b*. In order to avoid the receiver 42 being influenced by a signal from the opposite transmission unit 40, the detection of the signals is wavelength-dependent, whereby a different transmitting/receiving frequency is used for each side of a piecing robot 14*a–d*. Alternatively, the signals have different modulation as a function of the side of the piecing robot, so that the receiver 42 only detects the signal emitted on the same side from the corresponding transmission unit 40.

With this arrangement, the piecing robot 14*b* can also detect the position of the piecing robot 14*a* and vice versa. This possibility of position detection can also be used for a robot to signal the position of a robot (see below) out of service to the control unit 20*a*, 20*b* and/or to the spinning machine control system 22. If the central machine control 22 does, for example, not know the position of the piecing robot 14*a*, it can cause the piecing robot 14*b* to find that position. With the reception of this position signal, the travel movement control of the piecing robot 14*a* can be resumed.

In addition to or in lieu of the transmitting/receiving unit 40, 42 of FIG. 4, a distance detection unit (not shown) can be provided such as is known e.g. from motion detectors. Here too the transmission/receiving frequency varies depending on the side of the piecing robot 14*a–d*, so that the distance detection units across from each other will not influence each other. The distance signal can be evaluated in a discrete manner, whereby a signal above a given signal intensity is emitted. In this case a collision avoidance process would be triggered when the distance falls below a predetermined minimum. Alternatively, the distance from the respective obstacle or the facing spinning robot is not in steps but continuously, so that a distance-dependent collision avoidance process can be initiated.

In one mode of collision avoidance control, an obstacle and the distance to the obstacle are recorded by means of the distance detection unit. By scanning the data on the end points of the travel path (e.g. empty-bobbin feeding device 18) and on the positions of the other piecing robots 14*a–d* in the control unit 20*a*, 20*b*, 22, it may be found that there is an unforeseen obstacle, e.g. an operator 26. In order to prevent interference with the operator 26 caused by the approaching piecing robot 14*a–d*, the piecing robot is moved only up to a predetermined distance from the obstacle. The distance is calculated in such a manner in this case that the operator 26 may not feel rushed by the piecing rotor and is able to perform his service work undisturbed.

The described detection devices for the avoidance of collision can be provided in any desired combination with each other. Thus for example, a distance detection sensor 40, 41, 42 according to FIG. 4 with a switching hoop 24 and a emergency stop switch button 25 according to FIG. 2, or similar arrangement. By combining two or more detection devices per travel direction, the reliability of obstacle detection is increased. Here the position and distance determination between a piecing robot 14*a–d* and an obstacle by means of a control unit 20*a*, 20*b*, 22 or by means of the interaction of the control units serves to avoid a collision with the obstacles "known" to the spinning machine. Here appropriate measures can be initiated for the soft braking of the piecing robot before the obstacle and/or the controlled approach of the robot to the obstacle. The detection devices 23, 24, 25, 40, 41, 42 described above which detect an obstacle by contact or without contact serve above all to recognize "unforeseen" obstacles and intervene also when defects occur in the determination of the obstacles by means of the control unit 20*a*, 20*b*, 22.

The signals transmitted by the detection devices are used with different priorities in the control of the movement of the piecing robots 14*a*, 14*b*. The signal of the emergency stop switch button 25 for example, circumvents the control unit 20*a*, 20*b*, 22 and results directly in the drive of the piecing robot being switched off or braked. The first two steps of the switching unit 23 are evaluated with high priority by the respective control unit 20*a*, 20*b* for the braking of the piecing robot. A corresponding status message is transmitted to the control unit 22. On the other hand, the position or distance signals supplied by the control unit 20*a*, 20*b* and/or 22 are taken into account with low priority.

Braking, stopping and temporary waiting after stopping and/or the reversal of the direction of travel of piecing robot 14*a–d* are controlled by the control unit 20*a*, 20*b* of the piecing robots 14*a–d* and/or by the spinning machine control system 22 as a function of the type of signal received by the detection device. When the signal of a emergency stop switch button 25, of the third step of the switching hoop 24 and the switching unit 23 appears, or if a distance detection device (40, 41, 42) has detected that a minimum safety distance is not reached, the piecing robot is stopped immediately and remains in the stopped position until it is again put into operation with a release signal, e.g. upon verification by an operator 26. The distance signal with the minimum safety distance can here be provided also by the control units 21*a*, 21*b*, 22, by the transmission/receiving unit 40, 42, or by another distance sensor as described above.

The piecing robot can be braked as a function of the distance from the obstacle with greater deceleration as the distance decreases. If in that case the obstacle, e.g. another piecing robot, moves again away from the piecing robot, the latter can continue its travel without having to stop completely. However the piecing robot can also wait for a predetermined time span in its position after stopping to ascertain whether the obstacle moves away within a predetermined waiting time before it reverses its direction of travel. Thereby the spinning stations 13 are not left without service for any length of time in the direction of travel that was the robot's before braking. This is because due to the reversal of travel direction the service unit no longer checks the spinning stations in the original direction of travel, but those that are now in the opposite direction of travel. It may then still be possible that a spinning station requiring servicing cannot be approached if it is located on the path in the direction of the original direction of travel, shortly after the point of reversal.

Especially in the case in which position data is made available via the control units 21*a*, 21*b*, 22 concerning other piecing robots 14*a–d* and/or reversal points, as well as end points in the travel path of a piecing rotor, the reaction to an obstacle can be controlled as a function of the obstacle itself. Thus, for example, end points can be approached with the minimum distance to an obstacle not being observed. In FIG. 1 for example, the piecing robot 14 can be moved to a point directly in front of the empty-bobbin feeding device 18 even though a signal of a distance sensor signals an obstacle. When a return point is prescribed, the travel path of a piecing robot is predetermined by an arbitrarily prescribed position along the travel rail 15, 16, whereby the return point is not a physical end of the travel path. Such an end point is determined by one of the control units 20*a*, 20*b* or 22 or by an operator and can be defined freely.

When an obstacle is detected within an approach distance and it is recognized through the data comparison that it is another piecing robot, a predetermined minimum distance that may be greater than the safety distance from some other obstacle is observed. This ensures that two piecing robots, whereby one may be waiting at a piecing station 13, do not interfere with each other. The minimum distance could be e.g. the section width of 10 piecing stations 13.

If the service function fails in one of the piecing robots 14*a–d* so that it is no longer available for service at a spinning station 13, the piecing robot is moved to its starting position (for initialization, see below) or to a maintenance position. If the latter is not available or if another piecing robot must pass this location, an avoidance function of the deactivated piecing robot is actuated. The deactivated piecing robot then avoids an approaching piecing robot via the distance recognition system while observing a minimum distance. The minimum distance can be e.g. a section width of 10 piecing stations, and is cancelled when the defective piecing robot can no longer move away in avoidance direction because of some other obstacle, e.g. the empty-bobbin feeding device 18.

The control units 20*a*, 20*b* or the spinning machine control system 22 constantly monitor or calculate the current position of the piecing robots 14*a*, 14*b*. This takes place either through an initialization of the position of the piecing robot in its starting position, at which a position counter is installed at a fixed position along the guide rail 15, 16, and the position is then calculated based on the travel path distance covered, or else position markings are provided along the guide rails 15, 16 so that a detection device (not shown) can detect the current position of the piecing robot 14*a–d* concerned. The initialization may take place in a basic position or in several basic positions optionally selected. The determination of positions can also be effected through a combination of initialization, travel path determination and position comparison at the position markings. In this case, a position counter is reset in an initialization in the fixed starting position and the distance covered is determined from that point. The latter takes place through detection of position markings along the guide rails or a calculated value of the current position is compared to the detected position. As a rule, the position markings are relative markings, so that the service unit detects a distance covered based only on the relative position markings. The position markings may however also be absolute markings, so that the service unit is able to detect at each marking the absolute position at the textile machine. In the latter case the service unit can be moved to any position marking for initialization.

If the determination of the position of one of the piecing robots 14*a–d* is not made by the control units 20*a*, 20*b*, 22, the piecing robot remains at its position until the initialization in the starting position as described above can again be effected and determination of position is again ensured.

Figure 5A:
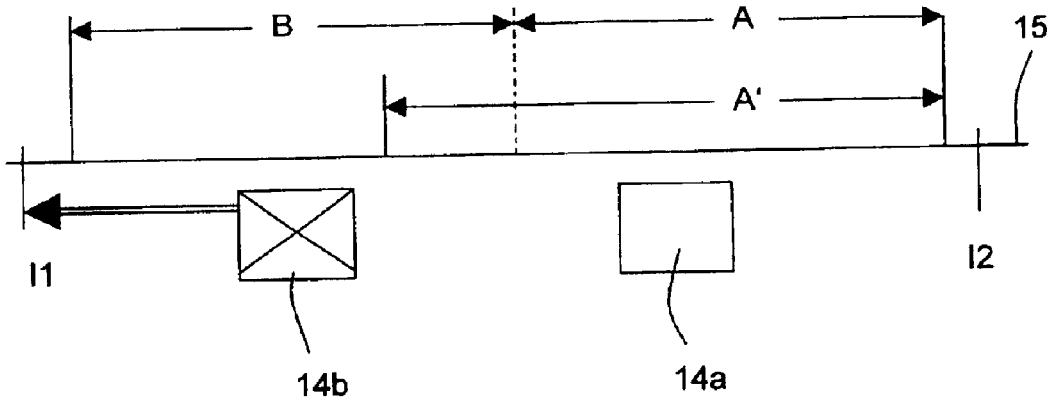
FIG. 5*a* shows the determination of the operating zone of a service unit in operation when a second service unit is out of operation.

FIG. 5*a* shows the situation of the piecing robots 14*a* and 14*b* when the piecing robot 14*b* has been taken out of operation. The piecing robot 14*b* could have been taken out of operation by an operator for instance, the travel controls could no longer be functioning or position data may no longer be available, so that the piecing robot 14*b* was stopped because of the missing position data. The normal operating zones A and B assigned respectively to the two piecing robots 14*a* and 14*b* in operation are assigned to the other piecing robot when one is no longer in operation. In FIG. 5*a* the operating zone of the piecing robot 14*a* is extended from A to A'. In this case it is assumed that the piecing robot 14*b* which is out of operation is stopped at the position at which it has last transmitted its latest position data, in case that these can no longer be detected. Alternatively, the piecing robot 14*b* taken out of operation transmits its current position data if it is still able to detect it.

The extended operating zone A' of the piecing robot 14*a* is sized so that a sufficient safety distance from the piecing robot 14*b* is observed, and so that no collision between the piecing robots may occur. The distance is preferably sufficiently great so that mutual influence by piecing robots 14*a*, 14*b* approaching each other too closely is reliably avoided. The distance is e.g. equal to one section width or to 10 spinning stations. To initialize the robot 14*b* that has been taken out of service, i.e. to find its absolute position on the guide rail 15, the piecing robot 14*b* is moved away by the robot 14*a* which is still in operation and into the initialization position I1. The determination of absolute position takes place in the initialization position I1. The initialization travel of the piecing robot 14*b* into initialization position I1 is caused either by the control unit 20*b* or 22 or by an operator. In this case the piecing robot 14*b* can also be moved manually into the initialization position I1. If the piecing robot 14*b* is still able to record the covered distance or the position marking along the travel path during this initialization travel it can transmit these to control unit 20*b* or 22. The control unit then extends continuously the operating zone A' of the piecing robot 14*a* by the distance covered by the robot 14*b*. If the initialization position I1 is located outside the area of the spinning stations, all the spinning stations on that spinning machine side can thus be covered by the extended operating zone A'.

Every piecing robot 14 has here its own initialization position I1, I2 or several initialization positions. To initialize the respective piecing robot, the initialization travel is initiated in such a manner that the piecing robot moves away from the closest piecing robot also capable of servicing its operating zone. If on the other hand, the piecing robot 14*b* that has been taken out of service is pushed in the direction of the piecing robot 14*a* that is in operation, e.g. by an operator, the distance covered by the piecing robot 14*b* is detected and the operating zone of the piecing robot 14*a* is decreased by that distance.

Figure 5B:
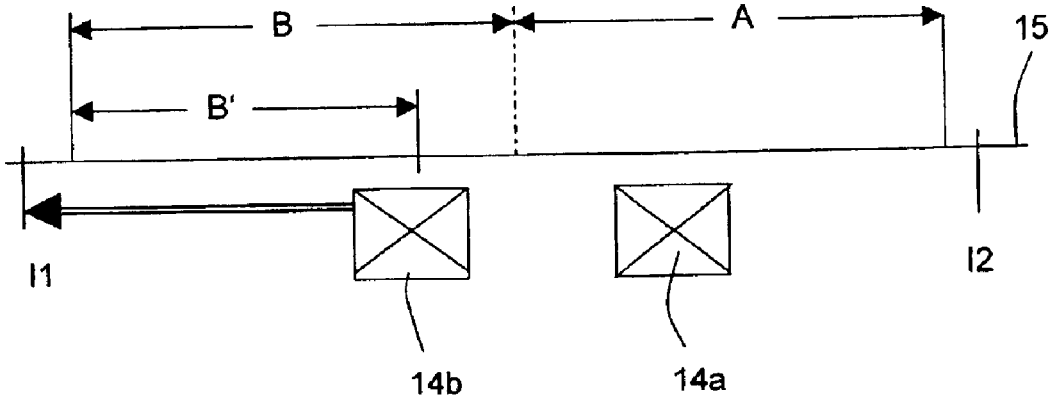
FIG. 5*b* shows the determination of an operating zone when two service units are out of operation.

FIG. 5*b* schematically shows a situation in which the two piecing rotors 14*a*, 14*b* are not yet initialized. This is the case e.g. after first start-up of the spinning machine 10. In this case neither the position of the piecing robot 14*a* nor of the piecing robot 14*b* is as yet known. To put the piecing robot 14*b* into operation, it is moved into the initialization position I1. During this initialization travel it covers the distance B' without encountering an obstacle. It can thus be assumed that the segment B' is a zone that can be freely traveled and this segment is defined as operating zone B' of the piecing robot 14*b* that it can service after initialization. Here too the distance B' covered during the initialization travel was detected, e.g. through position markings. Until the second piecing robot 14*a* has also been initialized in its initialization position I2 and the normal operating zones A, B can be assigned to the piecing robots 14*a*, 14*b*, the piecing robot 14*b* services the operating zone B'. As described above regarding FIG. 5*a*, the operating zone B' of the piecing robot 14*b* can be extended during the initialization travel of the piecing robot 14*a* to initialization position I2 by the distance covered by the piecing robot 14*a*, or can be reduced when the piecing robot 14*a* is moved towards the piecing rotor 14*b*.

Instead of measuring the covered travel distance or the relative position of a piecing robot taken out of operation, an operator can also enter the position of the piecing robot taken out of operation into the control unit. Sensors can however also be provided along the travel path to sense the piecing robot and to transmit the position of the piecing robot to the control unit 20*a*, 20*b*, 22 (e.g. central machine control).

Optionally the control unit can make available data for maximum admissible operating zones of the piecing robots. Information on maximum admissible operating zones are either preset permanently on the spinning machine or can be prescribed e.g. by an operator. The maximum admissible operating zones may for example coincide with the operating zones A, B in FIG. 5*a*. In this case the temporarily determined operating zones A' and B' in FIGS. 5*a* and 5*b* are shorter or at the most as long as the operating zones A and B. Such limits can be set as described above bilaterally or only unilaterally in one direction.

It should be appreciated by those skilled in the art that modifications and variations can be made to the embodiments of the invention described herein without departing from the scope and spirit of the invention as set forth in the claims and their equivalents.

What is claimed is:

1. A process for controlling the travel movement of a textile machine service unit, the service unit configured to travel on a guide rail alongside of a plurality of processing stations of the textile machine for performing servicing or control functions at the individual processing stations, said process comprising storing data in a control system related to any combination of travel path limitations of the service unit, predetermined return points of the service unit, and known obstacles in the travel path of the service unit; determining the travel movement of the service unit with the control system as a function of the stored data; and controlling movement of the service unit with the control system.

2. The process as in claim 1, further comprising transmitting from the service unit to the control system any combination of position of the service unit along the guide rail, direction of travel of the service unit, travel speed of the service unit, and dimensions of the service unit, the control system controlling the travel movement of the service unit as a further function of the transmitted data from the service unit.

3. The process as in claim 1, wherein the control system determines braking, stopping, and reversal points of the service unit as a function of any combination of distance from the service unit to travel path limit points, predetermined returned points, known obstacles, and travel speed of the service unit.

4. The process as in claim 1, wherein the service unit stops its travel movement upon detection by the service unit of an obstacle in the travel path.

5. The process as in claim 1, further comprising determining a current position of the service unit along the guide rail as a function of absolute position markings provided along the guide rail.

6. The process as in claim 1, wherein the textile machine includes at least a second service unit configured to travel on the guide rail, said process comprising determining the travel movement of the first service unit as a further function of data transmitted to the control system related to the second service unit.

7. The process as in claim 6, wherein the data related to the second service unit is any combination of position of the second service unit, direction of travel of the second service unit, travel speed of the second service unit, dimensions of the service unit, and operating status of the second service unit.

8. The process as in claim 6, further comprising determining and maintaining a minimum distance between the first and second service units based on position data of the service units along the guide rail transmitted to the control system or a signal indicating distance from one of the service units to the other respective service unit.

9. The process as in claim 8, further comprising determining initial positions of the first and second service units from a predetermined position along the guide rail, and deriving current positions of the first and second service units from the initialization positions.

10. The process as in claim 6, further comprising maintaining a minimum predetermined distance between the first service unit and the second service unit when the first service unit is deactivated.

11. The process as in claim 10, wherein the minimum predetermined distance is decreased when the second service unit is unable to avoid an obstacle in its travel path due to a travel movement delimitation.

12. The process as in claim 1, further comprising determining an initial position of the service unit from a predetermined position along the guide rail, and deriving a current position of the service unit from the initialization position.

13. The process as in claim 12, wherein the current position of the service unit is determined as a function of any combination of distance traveled by the service unit, speed of the service unit, and relative position markings along the travel path of the service unit.

14. A process for controlling the travel movement of a textile machine service unit, the service unit configured to travel on a guide rail alongside of a plurality: of processing stations of the textile machine for performing servicing or control functions at the individual processing stations, said process comprising:

storing data in a control system related to any combination of travel path limitations of the service unit, predetermined return points of the service unit, and known obstacles in the travel path of the service unit;

determining the travel movement of the service unit with the control system as a function of the stored data; and controlling movement of the service unit with the control system;

wherein the control system determines braking, stopping, and reversal points of the service unit as a function of any combination of distance from the service unit to travel path limit points, predetermined returned points, known obstacles, and travel speed of the service unit; and wherein braking force of the service unit is varied as a function of travel speed of the service unit and distance of the service unit from a travel path limit point or reversal point.

15. A process for controlling travel movement of at least a first and a second textile machine service unit, the service units configured to travel on a guide rail alongside of a plurality of processing stations of the textile machine for performing servicing or control functions at the individual processing stations, said process comprising defining individual operating zones of processing stations for the respective service units and storing data in a control system related to the operating zones including information on travel path limitations of the service unit, predetermined return points of the service unit, and known obstacles in the travel path of the service unit; and controlling movement of the service units with the control system as a function of the operating zone data including the maintaining of the service units within their respective operating zones.

16. A process for controlling travel movement of at least a first and a second textile machine service unit, the service units configured to travel on a guide rail alongside of a plurality of processing stations of the textile machine for performing servicing or control functions at the individual processing stations, said process comprising:

defining individual operating zones of processing stations for the respective service units and storing data in a control system related to the operating zones;

controlling movement of the service units with the control system as a function of the operating zone data so as to maintain the service units within their respective operating zones; and expanding the operating zone of the second service unit upon the first service unit being out of operation, the operating zone of the second service unit expanded to the actual present position or last determined position of the first service unit within the operating zone of the first unit regardless of whether the first service unit is still within the operating zone of first unit.

17. The process as in claim 16, wherein the current position of the first service unit is transmitted to the control system for expanding the operating zone of the second service unit.

18. A process for controlling travel movement of at least a first and a second textile machine service unit, the service units configured to travel on a guide rail alongside of a plurality of processing stations of the textile machine for performing servicing or control functions at the individual processing stations, said process comprising:

defining individual operating zones of processing stations for the respective service units and storing data in a control system related to the operating zones;

controlling movement of the service units with the control system as a function of the operating zone data so as to maintain the service units within their respective operating zones; and wherein upon the first and second service units being out of operation, a temporary operating zone of the service unit first put into operation is redefined to be a zone over which the service unit moved during travel to an initialization position without collision with the other service unit.

19. The process as in claim 18, wherein a temporary operating zone of the other service unit is redefined as a function of the redefined operating zone of the service unit first put into operation.

20. The process as in claim 19, wherein the other service units is moved to its initialization position and the first and second service units are initialized, the respective operating zones of the first and second service units being reset to their original operating zones.

21. The process as in claim 19, wherein the temporary operating zone of the other service unit is redefined as a function of distance traveled by the service unit first put into operating as it moves to its initialization position.

22. The process as in claim 21, wherein the distance traveled by the service unit first put into operation is determined by position markings provided at each processing station of the textile machine.

* * * * *

UNITED STATES PATENT AND TRADEMARK OFFICE

CERTIFICATE OF CORRECTION

PATENT NO. : 6,907,309 B2
APPLICATION NO. : 10/202402
DATED : June 14, 2005
INVENTOR(S) : Martin Zipperer It is certified that error appears in the above-identified patent and that said Letters Patent is hereby corrected as shown below:

Title Page, Item (73)
Please correct the spelling of the Assignee to read as follows:

Rieter Ingolstadt Spinnereimaschinenbau AG

Signed and Sealed this

Fifth Day of February, 2008

JON W. DUDAS
*Director of the United States Patent and Trademark Office*